US005953568A

United States Patent [19]

Fujishiro et al.

[11] Patent Number: 5,953,568

[45] Date of Patent: Sep. 14, 1999

[54] DEVELOPING UNIT FOR AN IMAGE FORMING APPARATUS HAVING A MAGNETIC ROTATING BLADE AGITATOR

[75] Inventors: Takatsugu Fujishiro, Tokyo; Nobuhiko Umezawa, Kanagawa; Hajime Oyama, Chiba; Motonori Hanada, Kanagawa, all of Japan

[73] Assignee: Ricoh Company, Ltd., Tokyo, Japan

[21] Appl. No.: 09/061,247

[22] Filed: Apr. 17, 1998

[30] Foreign Application Priority Data

Apr. 19, 1997 [JP] Japan ..... 9-116193

[51] Int. Cl.[6] ..... G03G 15/09

[52] U.S. Cl. ..... 399/267; 399/256; 399/272

[58] Field of Search ..... 399/272, 254, 399/256, 258, 267, 262, 274; 366/273

[56] References Cited

U.S. PATENT DOCUMENTS

| | | | |
|---|---|---|---|
| 4,188,907 | 2/1980 | Lipani | 399/261 |
| 4,393,810 | 7/1983 | Kasper | 399/254 |
| 4,607,938 | 8/1986 | Hosoi et al. | 399/259 |
| 4,619,518 | 10/1986 | Kameyama et al. | 399/231 |
| 5,027,157 | 6/1991 | Hotomi et al. | 399/253 |
| 5,565,966 | 10/1996 | Ochiai et al. | 399/274 |
| 5,617,189 | 4/1997 | De Cock et al. | 399/254 |
| 5,832,350 | 11/1998 | Kumasaka | 399/272 X |

*Primary Examiner*—Matthew S. Smith

*Attorney, Agent, or Firm*—Oblon, Spivak McClelland, Maier & Neustadt, P.C.

[57] ABSTRACT

A developing unit of the present invention includes a developing roller facing a photoconductive element and formed with a magnetic layer on its circumference. The magnetic layer has a plurality of magnetic poles of opposite polarities alternating with each other and each extending in the axial direction of the developing roller. A developer consisting of magnetic particles an toner are deposited on the developing roller by the magnetic poles and conveyed by the roller to the photoconductive element carrying a latent image thereon, thereby developing the latent image. An agitator for agitating the magnetic particles and toner is positioned relative to the developing roller such that a blade thereof has an agitation range overlapping with the magnetic force range of the magnet layer. With this configuration, it is possible to insure high quality images free from background contamination and toner scattering while extending the service life of the developing unit.

5 Claims, 3 Drawing Sheets

DEVELOPING UNIT FOR AN IMAGE FORMING APPARATUS HAVING A MAGNETIC ROTATING BLADE AGITATOR

BACKGROUND OF THE INVENTION

The present invention relates to a facsimile apparatus, printer or similar electrophotographic image forming apparatus and, more particularly, to a developing unit applicable to such an image forming apparatus for developing a latent image electrostatically formed on a photoconductive element.

A conventional developing unit for the above application includes a developing roller made up of a rotatable magnet roller and a rotatable developing sleeve coupled over the magnet roller. The magnet roller has a plurality of permanent magnets of opposite poles alternating with each other and each extending in the axial direction of the roller. The developing sleeve is a hollow cylinder formed of a nonmagnetic material. The developing roller is located to face a photoconductive element. A magnetic developer is deposited on the surface of the sleeve in the form of a magnet brush so as to develop a latent image electrostatically formed on the photoconductive element.

The above developing unit insures stable development free from the scattering of toner and the mixture of toner of different colors by preventing the magnetic adhesion of the developer to the developing sleeve from decreasing. For example, Japanese Patent Laid-Open Publication No. 7-219283 discloses a color image forming apparatus including a developing roller implemented by a cylindrical permanent magnet member having a plurality of magnetic poles thereon. A magnetic developer is deposited on the developing roller in the form of a layer whose thickness is smaller than a gap between the developing roller and the photoconductive element. While the developer is conveyed by the developing roller, an AC-biased DC voltage is applied between the photoconductive element and the developer so as to develop a latent image.

On the other hand, Japanese Patent Laid-Open Publication No. 8-328387 proposes a developing unit including a developing roller implemented by a cylindrical permanent magnet member having a plurality of magnetic poles thereon which are arranged at a pitch of 0.5 mm to 10 mm. The developing roller and a photoconductive element are rotated in opposite directions to each other. The developing roller and photoconductive element are respectively rotated at peripheral speeds of Vm (mm/s) and Vp (mm/s) satisfying a relation of $5 \geqq Vm/Vp \geqq 1$.

The above conventional developing units each includes a casing formed with an opening at its bottom portion. The developing roller is disposed in the opening. A doctor is affixed to the lower edge of the opening for regulating the thickness of toner. Toner is stored in a toner storing section included in the casing and fed therefrom to be charged by friction acting between it and magnetic particles in the opening. Consequently, the toner is electrostatically deposited on the magnetic particles and conveyed by the developing roller to a position where the roller faces the photoconductive element.

Although a great amount of magnetic particles may exist in the casing, not all of them contribute to development or the charging of the toner. It follows that the toner cannot be sufficiently charged in a short period of time or to sufficiently develop a latent image formed on the drum. This brings about the contamination of a background and the scattering of the toner and thereby reduces the service life. Moreover, while fresh toner is replenished from the toner storing section, the toner short of charge due to insufficient friction acting between it and the magnetic particles in the opening is conveyed by the developer deposited on the developing roller. This also brings about background contamination and toner scattering.

SUMMARY OF THE INVENTION

It is therefore an object of the present invention to provide a developing unit for an image forming apparatus and capable of noticeably increasing the ratio of magnetic particles contributing to development and the charging of toner and thereby insuring high quality images while achieving an extended service life.

In accordance with the present invention, a developing unit for developing a latent image electrostatically formed on an image carrier with a developer consisting of magnetic particles and toner includes a rotatable developer carrier adjoining and facing the image carrier and having on its circumference a plurality of magnetic poles of opposite polarities alternating with each other and each extending in the axial direction of the developer carrier. The developer is deposited on the circumference of the developer carrier by the magnetic poles and conveyed to an image forming region assigned to the image carrier to thereby develop a latent image formed on the image carrier. An agitator for agitating the magnetic particles and toner is positioned relative to the image carrier such that the agitator has an agitation range overlapping with the magnetic force range of the developer carrier.

BRIEF DESCRIPTION OF THE DRAWINGS

The above and other objects, features and advantages of the present invention will become apparent from the following detailed description taken with the accompanying drawings in which.

In the drawings, identical reference numerals denote identical structural elements.

DESCRIPTION OF THE PREFERRED EMBODIMENT

Figure 1:
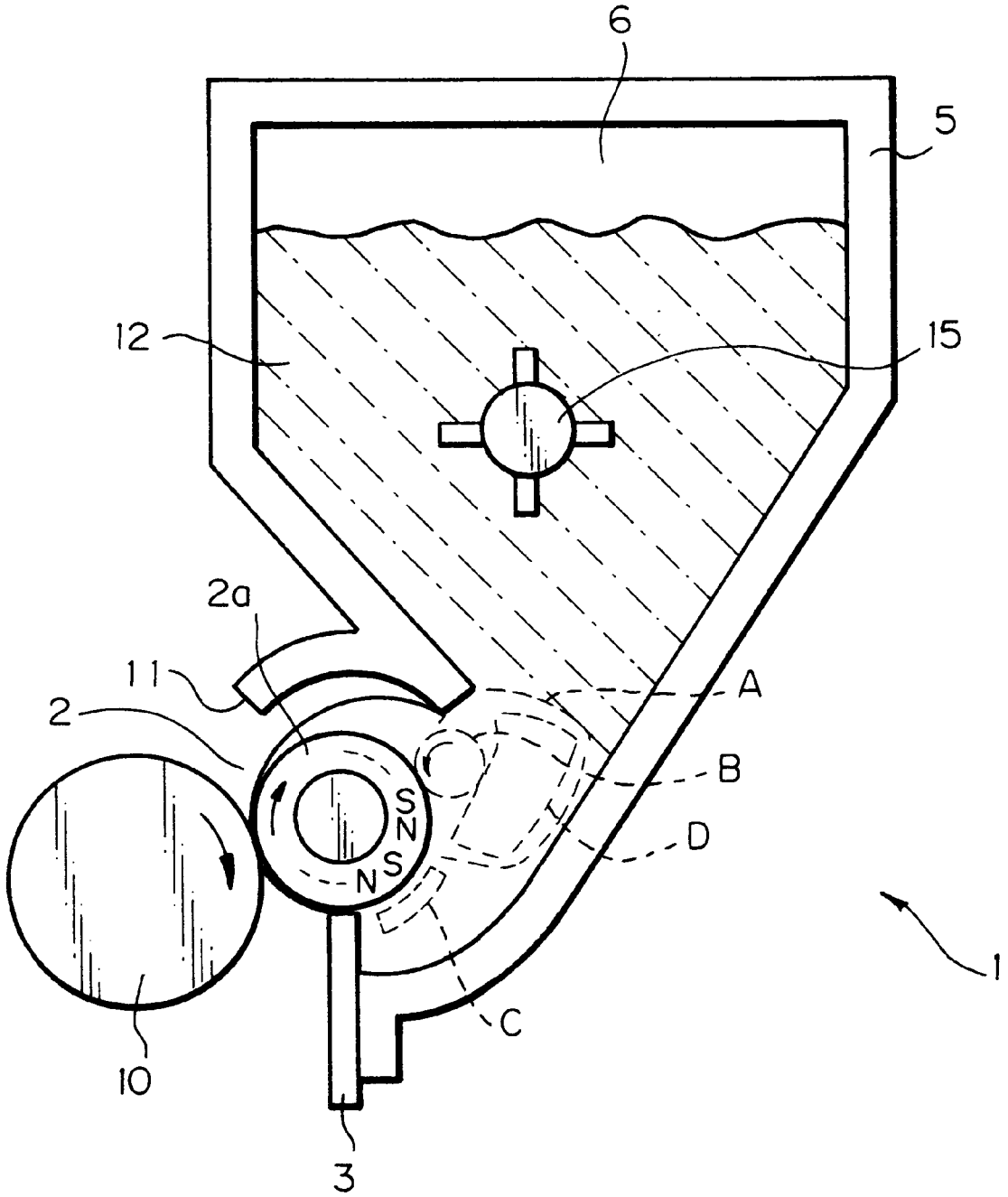
Fig. 1 PRIOR ART
FIG. 1 is a section showing a conventional developing unit included in an image forming apparatus.

To better understand the present invention, brief reference will be made to a conventional developing unit included in an image forming apparatus, shown in FIG. 1. As shown, the developing unit, generally 1, includes a casing 5 formed with an opening 11 at its bottom portion. A rotatable developing roller 2 is disposed in the opening 11. A doctor 3 is affixed to the lower edge of the opening 11 for regulating the thickness of toner. A photoconductive element implemented as a rotatable drum 10 faces and adjoins the developing roller 2. Toner 12 is stored in a toner storing section 6 included in the casing 5. A hollow cylindrical magnet layer 2*a* is formed on the circumference of the developing roller 2 and provided with a plurality of magnetic poles, as illustrated. An agitator 15 is disposed in the toner storing section 6 in order to agitate the toner 12. Further, when the amount of toner 12 decreases below a preselected amount, the agitator 15 detects the decrease on the basis of the varying agitation torque and outputs a report indicative of the need for toner replenishment.

A developer collecting portion A is formed in the vicinity of the opening 11 of the casing 5. A circulating portion B is positioned at the upstream side of the developer collecting portion A in the direction of rotation of the developing roller 2. In the circulating portion B, the developer is circulated by the magnetic force of the developing roller 2. In this condition, the toner 12 fed from the toner storing section 6 is charged by friction acting between it and magnetic particles in the circulating portion B. Consequently, the toner is electrostatically deposited on the magnetic particles and conveyed by the developing roller 2 to a position where the roller 2 faces the drum 1.

Generally, with a developing device using a toner and magnetic particle mixture, i.e., a two-ingredient type developer, it is necessary to maintain the toner content, i.e., the mixture ratio of toner to magnetic particles constant in order to deposit a preselected amount of charge on the toner. For this purpose, the toner content must be sensed. By contrast, in the developing unit 1, only the toner charged in the circulating portion B is deposited on and conveyed by the developing roller 2. This obviates the need for a sophisticated mechanism for sensing a toner content and controlling it and thereby simplifies the construction. Further, when the toner 12 in the toner storing section 6 decreases below a preselected amount, a report indicative of the need for toner replenishment is output on the basis of a decrease in the torque of the agitator 15. In response, fresh toner is replenished to the developing unit 1.

Among the magnetic particles existing in the casing 5, the particles deposited on the developing roller 2, the particles present in the circulating portion B and the particles adjoining a region C, FIG. 1, and not conveyed by the roller 2, but frictionally contact the toner deposited on the roller 2 for charging it, contribute to development or the charging of the toner. Although a great amount of magnetic particles may exist in the casing 5, the particles existing over a relatively broad range D, FIG. 1, of the developer collecting portion A other than the circulating portion B do not contribute to development or the charging of the toner at all.

Because friction repeatedly acts between the magnetic particles and the toner, the magnetic particles have their surfaces and therefore their toner charging ability sequentially deteriorated, as well known in the art. It follows that when only a part of the magnetic particles in the casing 5 contributes to the charging of the toner, the toner cannot be sufficiently charged in a short period of time or to sufficiently develop a latent image formed on the drum 10.

This brings about the contamination of a background and the scattering of the toner and thereby reduces the service life of the image forming apparatus. Moreover, while fresh toner is replenished from the toner storing section 6, the toner short of charge due to insufficient friction acting between it and the magnetic particles in the circulating portion B is conveyed by the developer deposited on the developing roller 2. This also brings about background contamination and toner scattering.

Figure 2:
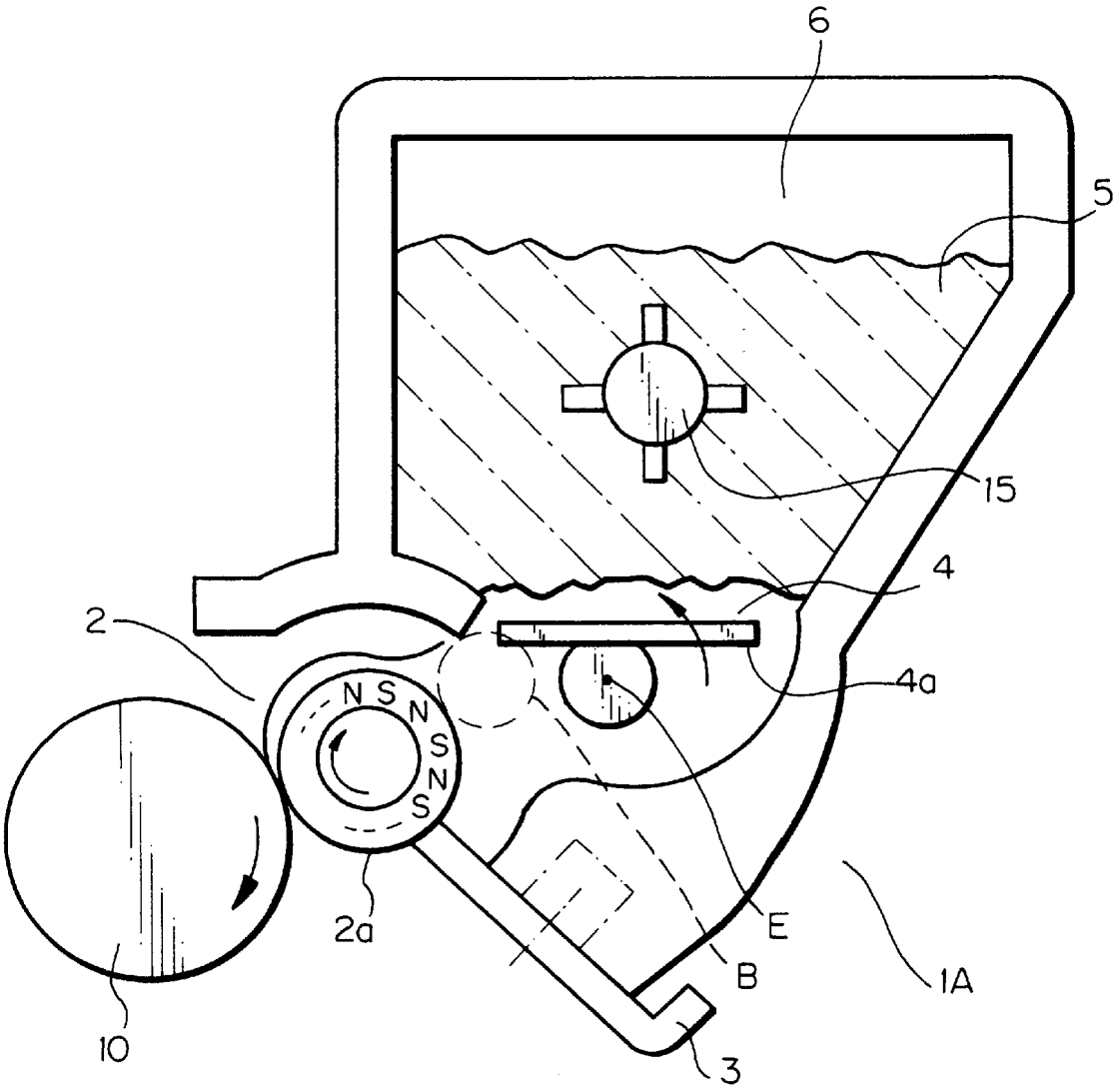
FIG. 2 is a section showing a developing unit embodying the present invention.
Figure 3:
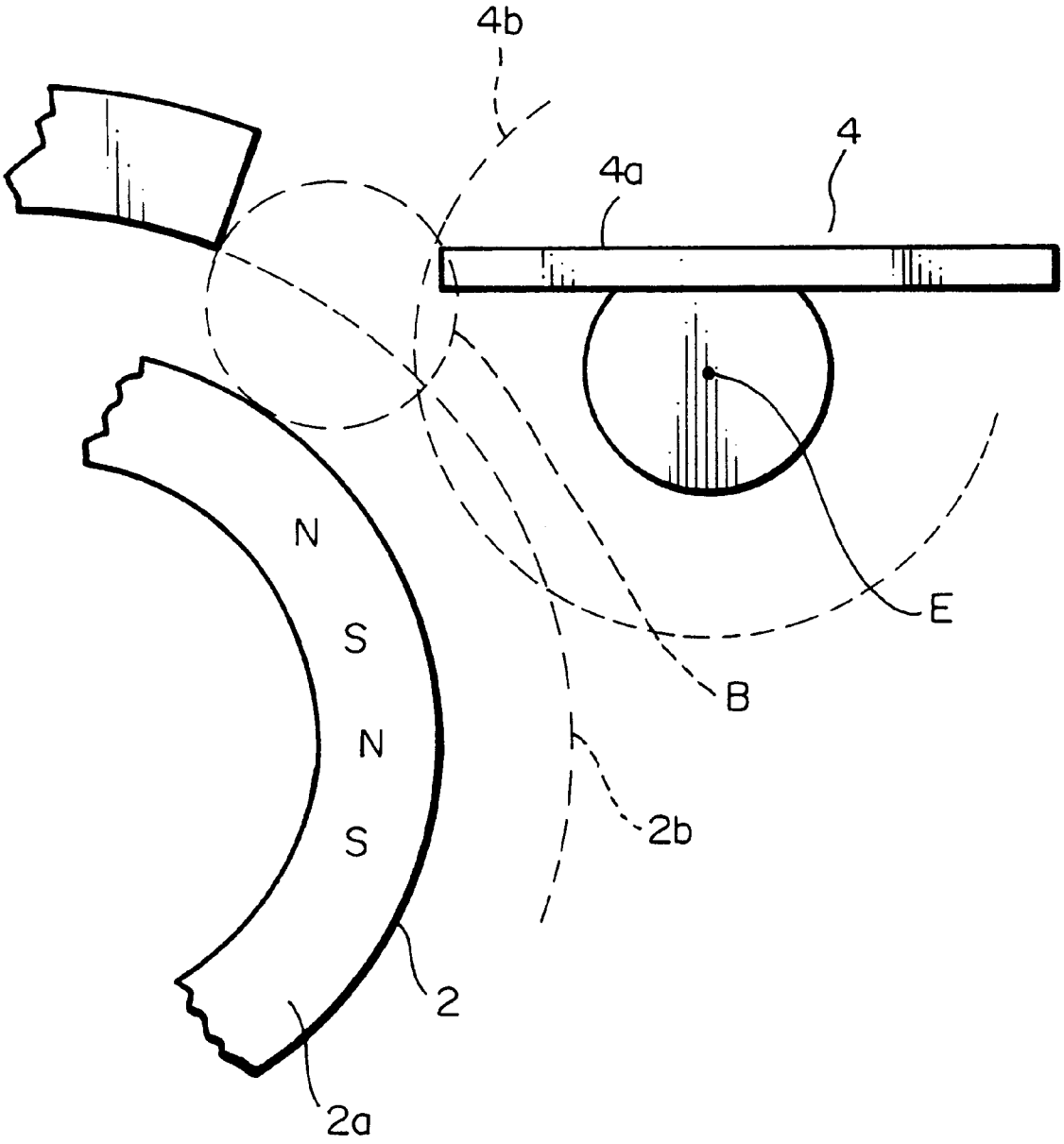
FIG. 3 demonstrates the operation of the illustrative embodiment.

Referring to FIGS. 2 and 3, a developing unit embodying the present invention will be described. As shown in FIG. 2, the developing unit, generally 1A, differs from the conventional developing unit 1 in that an agitator 4 faces a developing roller or developer carrier 2 and rotates counterclockwise, as viewed in FIG. 2, about a shaft E so as to agitate magnetic particles and toner. The agitator 4 includes a blade 4*a* formed of a magnetic material. As shown in FIG. 3, the agitator 4 is positioned relative to the developing roller 2 such that the agitator 4 has an agitation range 4*b* overlapping with a range 2*b* over which the magnetic force of the developing roller 2 acts. As for the rest of the construction, the illustrative embodiment is identical with the conventional developing unit 1.

In operation, when the agitator 4 of the developing unit 1A is rotated about the shaft E, its blade 4*a* agitates the magnetic particles and toner with its edges while moving over the agitation range 4*b*. As a result, the toner is frictionally charged and driven to a circulating portion B adjoining the developing roller 2. The developer agitated by the agitator 4 is fed into the magnetic force range 2*b* of the developing roller 2 and magnetically deposited on the roller 2. In this manner, the developer agitated by the agitator 4 is surely transferred to the developing roller 2. As a result, a greater amount of magnetic particles than conventional one contributes to development and the charging of the toner. The developer deposited on the developing roller 2 is conveyed by the roller 2 toward a photoconductive drum 10 while being regulated in thickness by a doctor 3. Consequently, the developer develops a latent image formed on the drum 10 and thereby produces a corresponding toner image.

Further, when either one of the edges of the blade 4*a* approaches the surface of the developing roller 2, it enhances the magnetic force of the roller 2 because the blade 4*a* is formed of a magnetic material. As a result, the flow of the developer in the circulating portion B is disturbed. It follows that friction between the toner and the magnetic particles is enhanced and allows the developer to be more surely transferred to the developing roller. As for the rest of the operation, the illustrative embodiment is identical with the conventional developing unit 1A.

As stated above, in the illustrative embodiment, the drum 10 for forming a latent image thereon and the developing roller 2 having the magnet layer 2*a* adjoin each other. The magnetic layer 2*a* has a plurality of magnetic poles of opposite polarities alternating with each other and each extending the axial direction of the developing roller 2. The magnetic poles cause the developer consisting of the magnetic particles and toner to deposit on the developing roller 2. This part of the developer is conveyed to a latent image forming region where the developing roller 2 faces the drum 10. Because the agitation range 4*b* of the blade 4*a* and the magnetic force range 2*b* of the magnet layer 2*a* overlap each other, the ratio of the charged particles contributing to development and the charging of the toner is increased. This successfully insures high quality images free from background contamination or toner scattering while extending the life of the image forming apparatus.

In summary, it will be seen that the present invention provides a developing unit capable of increasing the ratio of charged particles contributing to development and the charging of toner, and thereby insuring high quality images free from background contamination and toner scattering while achieving an extended service life.

Various modifications will become possible for those skilled in the art after receiving the teachings of the present disclosure without departing from the scope thereof.

What is claimed is:

1. A developing unit for developing a latent image electrostatically formed on an image carrier with a developer consisting of magnetic particles and toner, said developing unit comprising:

a rotatable developer carrier adjoining and facing the image carrier and having on a circumference thereof a plurality of magnetic poles of opposite polarities alternating with each other and each extending in an axial direction of said developer carrier, wherein the developer is deposited on a circumference of said developer carrier by said magnetic poles and conveying to an image forming region assigned to the image carrier to thereby develop a latent image formed on the image carrier; and an agitator for agitating the magnetic particles and the toner, said agitator including a rotating blade having at least edges of said blade formed of a magnetic material and positioned relative to the image carrier such that an agitation range of said agitator overlaps with a magnetic force range of said developer carrier causing a magnetic force of said rotatable developer carrier to be enhanced.

2. A developing unit as claimed in claim 1, wherein said agitator agitates the magnetic particles and the toner such that the toner is conveyed toward an upstream side in a direction of rotation of said developer carrier.

3. A developing unit as claimed in claim 1, wherein said agitator includes a shaft which rotates, said rotating blade being mounted on said shaft eccentrically.

4. A developing unit as claimed in claim 1, further comprising an additional agitator, said additional agitator being located in a toner storing section and outside the magnetic force range of said developer carrier.

5. A developing unit according to claim 1, wherein said agitator increases the ratio of charged particles contributing to development and charging of toner.

* * * * *